US005897470A

United States Patent [19]

Chen

[11] Patent Number: 5,897,470

[45] Date of Patent: Apr. 27, 1999

[54] EXERCISE DEVICE

[76] Inventor: Chih-Liang Chen, No. 10, Lane 1431, Kuanghsing Rd., Taoyuan Hsien, Taiwan

[21] Appl. No.: 09/006,801

[22] Filed: Jan. 14, 1998

[51] Int. Cl.[6] ..... A63B 21/02

[52] U.S. Cl. ..... 482/123; 482/93; 482/130; 482/140; 482/142

[58] Field of Search ..... 482/92, 93, 95, 482/96, 105, 121–123, 129, 130, 133, 134, 139, 140, 141, 142, 908; 297/16.1, 17, 25, 26, 354.12, 377, 378.1, 378.12, 452.3; D21/673, 662, 676, 686–691; D6/367, 368

[56] References Cited

U.S. PATENT DOCUMENTS

| | | | |
|---|---|---|---|
| D. 395,685 | 6/1998 | Cayne et al. | D21/662 |
| 1,865,030 | 6/1932 | McCauley | 297/372 |
| 1,973,945 | 9/1934 | Chavin et al. | 482/130 |
| 3,427,023 | 2/1969 | Silberman | 482/126 |
| 4,921,247 | 5/1990 | Sterling | 482/130 |
| 4,962,923 | 10/1990 | Earner | 482/55 |
| 5,007,632 | 4/1991 | Wilkinson | 482/130 |
| 5,056,778 | 10/1991 | Hull et al. | 482/105 |
| 5,080,353 | 1/1992 | Tench | 482/130 |
| 5,110,122 | 5/1992 | Moore et al. | 482/123 |
| 5,232,426 | 8/1993 | Van Straaten | 482/130 |

FOREIGN PATENT DOCUMENTS

| | | | |
|---|---|---|---|
| 2107999 | 5/1983 | United Kingdom | 482/130 |

*Primary Examiner*—Jeanne M. Clark
*Attorney, Agent, or Firm*—Pearne, Gordon, McCoy & Granger LLP

[57] ABSTRACT

An exercise device includes a base and a seat. The base has a pair of parallelly spaced first rods and a second rod extending between the pair of spaced first rods. The seat is mounted on one of the pair of the spaced first rods for a person to be seated thereon and has a pair of elastic cables respectively mounted at two sides thereof. The pair of elastic cables has two handles respectively and securely mounted to free ends thereof. Optionally, a weight element is mounted on the seat. The weight element is configured as a container in which liquid can be selectively stored to vary the weight thereof. Additionally, the exercise device includes a third rod. A first end of the third rod is pivotally mounted to a predetermined position of the second rod of the base and a second end of the third rod is pivotally engaging with a seatback. The seatback also has a pair of resilient cables respectively mounted thereon and having a handle securely connected to free end thereof.

5 Claims, 5 Drawing Sheets

EXERCISE DEVICE

BACKGROUND OF THE INVENTION

1. Field of the Invention

The present Invention relates to an exercise device, and more particularly to a foldable exercise device which has multiple functions.

2. Description of Related Art

In general, exercise devices are popularly used in the modern society. Since they are movable and do not occupy a large space, the exercise device enable people to exercise indoors. However, conventional exercise device are generally designed to work out a specific part of the body, such as arms, legs, and abdomen. These exercise devices are not satisfactory for the purpose of building up the whole body. Later, one kind of exercise device with multiple functions has been developed. However, this exercise device always has a complex structure, therefore, it is difficult to operate and has a high cost. Furthermore, this exercise device occupies a large space.

The present invention provides an improved exercise device to mitigate and/or obviate the aforementioned problems.

SUMMARY OF THE INVENTION

The main object of the present invention is to provide an exercise device which has a simple structure and provides multiple functions.

Another object of the present invention is to provide an exercise device which is foldable to facilitate convenient storage.

Other objects, advantages and novel features of the invention will become more apparent from the following detailed description when taken in conjunction with the accompanying drawings.

DETAILED DESCRIPTION OF PREFERRED EMBODIMENT

Figure 1:
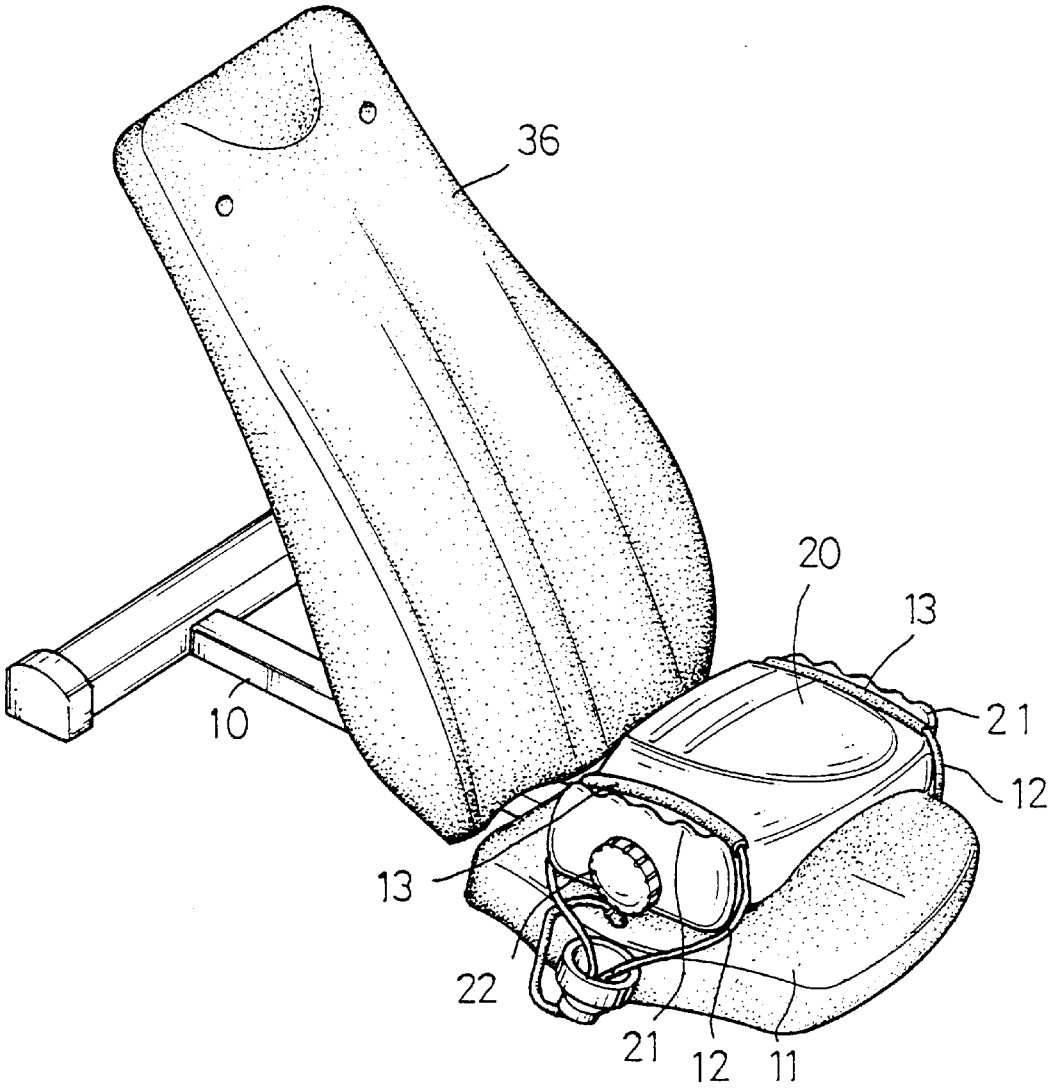
FIG. 1 is a perspective view showing an exercise device in accordance with the present invention.
Figure 2:
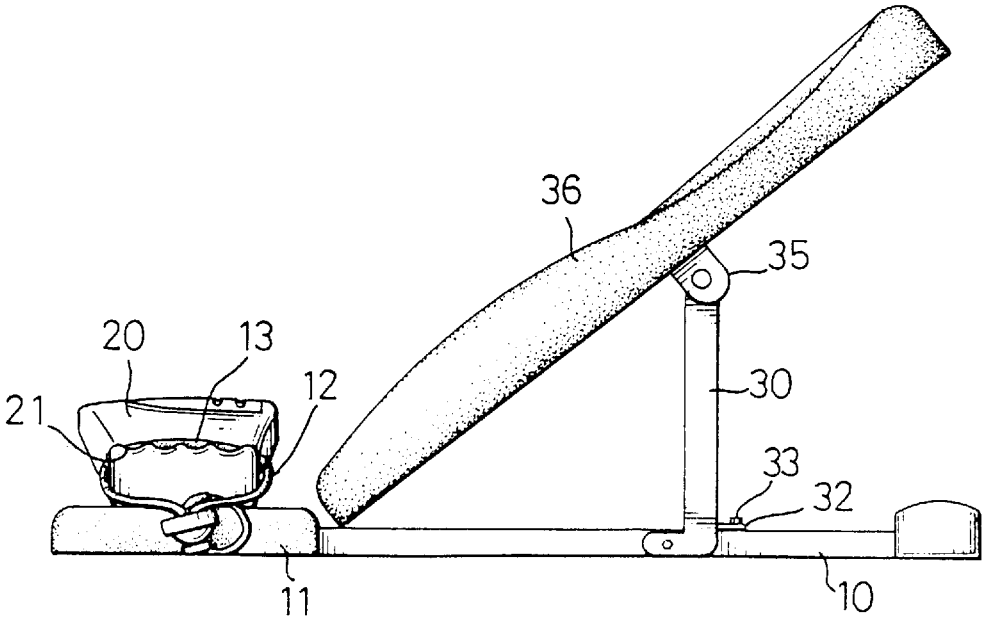
FIG. 2 is a side view of the exercise device in accordance with the present invention.

Referring to FIG. 1 and FIG. 2, an exercise device constructed in accordance with the present invention includes a base 10. The base 10 has a pair of parallelly spaced first rods (not numbered) and a second rod (not numbered) extending between the pair of spaced first rods. A seat 11 is mounted on one of the pair of spaced rods for a person to be seated thereon. The seat 11 has a pair of elastic cables 12 respectively mounted at two sides thereof. The pair of elastic cables 12 has two handles 13 respectively and securely mounted to free ends thereof.

The exercise device further includes a weight element 20 detachably mounted on the seat 11. In a preferred embodiment, the weight element 20 is configured as a container which has a cap 22 mounted thereto and in which liquid can be stored as desired to vary the weight of the container. The weight element 20 has a pair of recesses 21 respectively defined in two sides of a top surface thereof such that the handles 13 of the pair of elastic cables 12 can be received therein when not in use.

Figure 3:
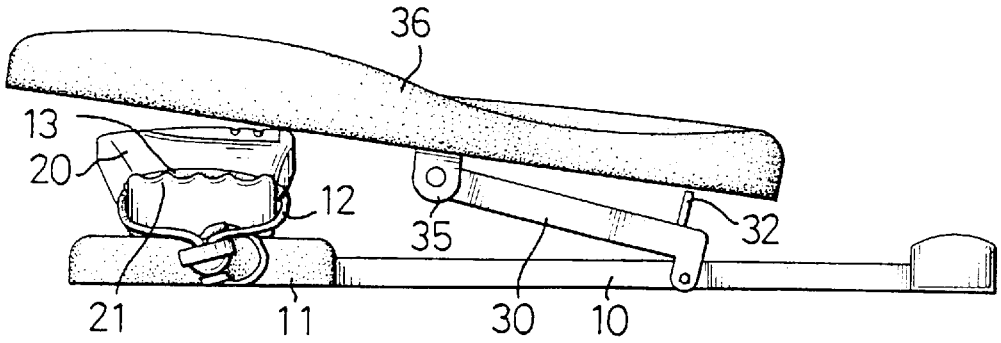
FIG. 3 is a side view showing a folding state of the exercise device in accordance with the present invention.

Additionally, the exercise device has a third rod 30 having a first end (not numbered) pivotally mounted to a predetermined position of the second rod of the base 10 and a second end (not numbered) pivotally engaging with a seatback 36. The first end of the third rod 30 is right angled so that the third rod 30 can be close to the second rod to reduce the volume when it is pivoted with respect to the second rod for folding, as shown in FIG. 3. The second end of the third rod 30 has an articulated extension 35 formed thereon to mount with the seatback 36. With this arrangement, the seatback 36 can be pivoted with respect to the third rod 30 for folding. Furthermore, a wing 32 perpendicularly extends from proximate the first end of the third rod 30 in a manner that it can be securely attached to a surface of the second rod of the base 10 via an insertion of a bolt 33 through the wing 32 and the surface of the second rod. In this way, the third rod 30 can be securely located to be perpendicular to the second rod. Furthermore, the seatback 36 has a pair of resilient cables 50 respectively mounted at two sides thereof to and a pair of handles 51 respectively mounted on free ends of each of the pair of the resilient cables 50, such that a user is able to lie on the seatback 36 with each hand holding a respective handle 51 to work out a specific part of the body.

Figure 4:
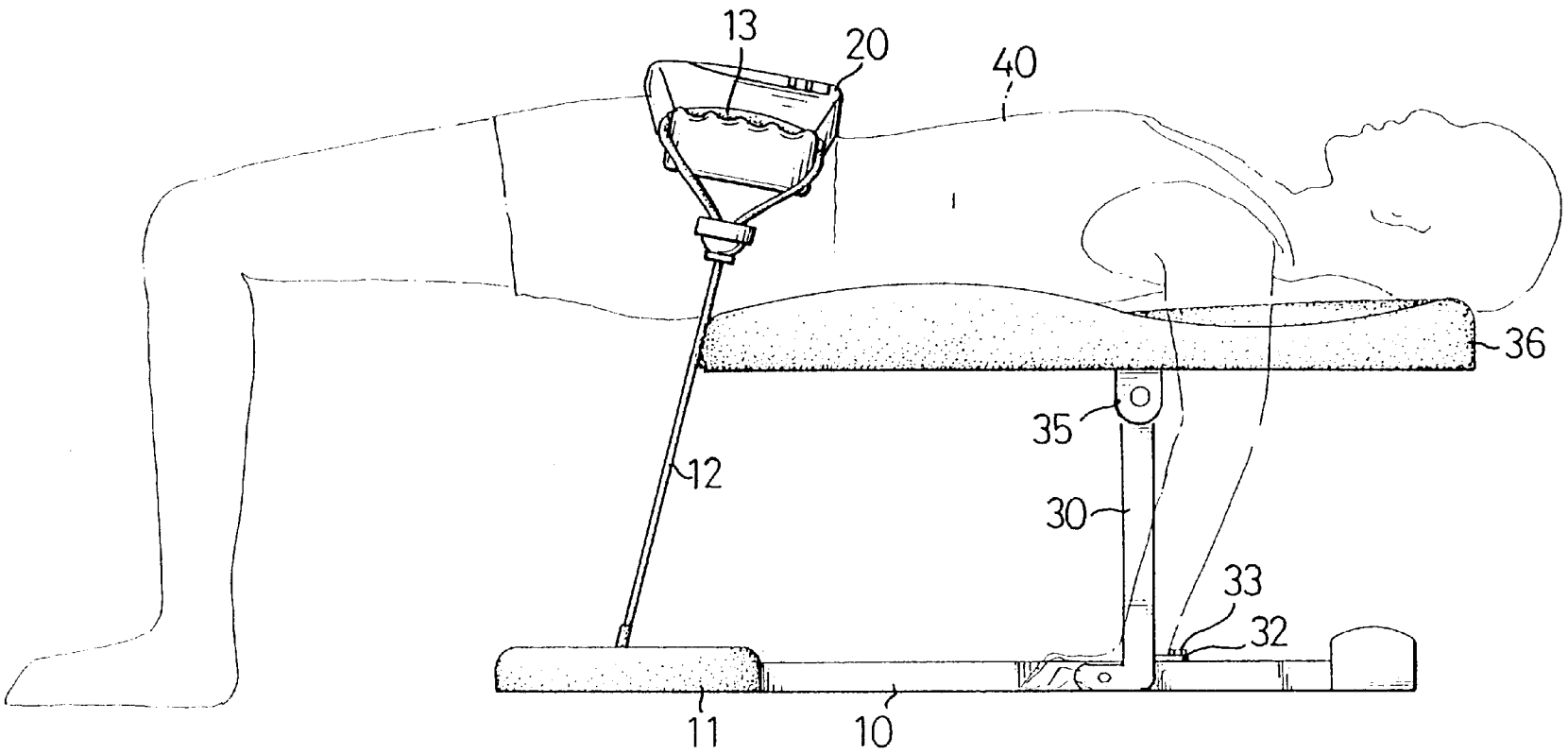
FIG. 4 is a schematic view showing a first application of the exercise device in accordance with the present invention.
Figure 5:
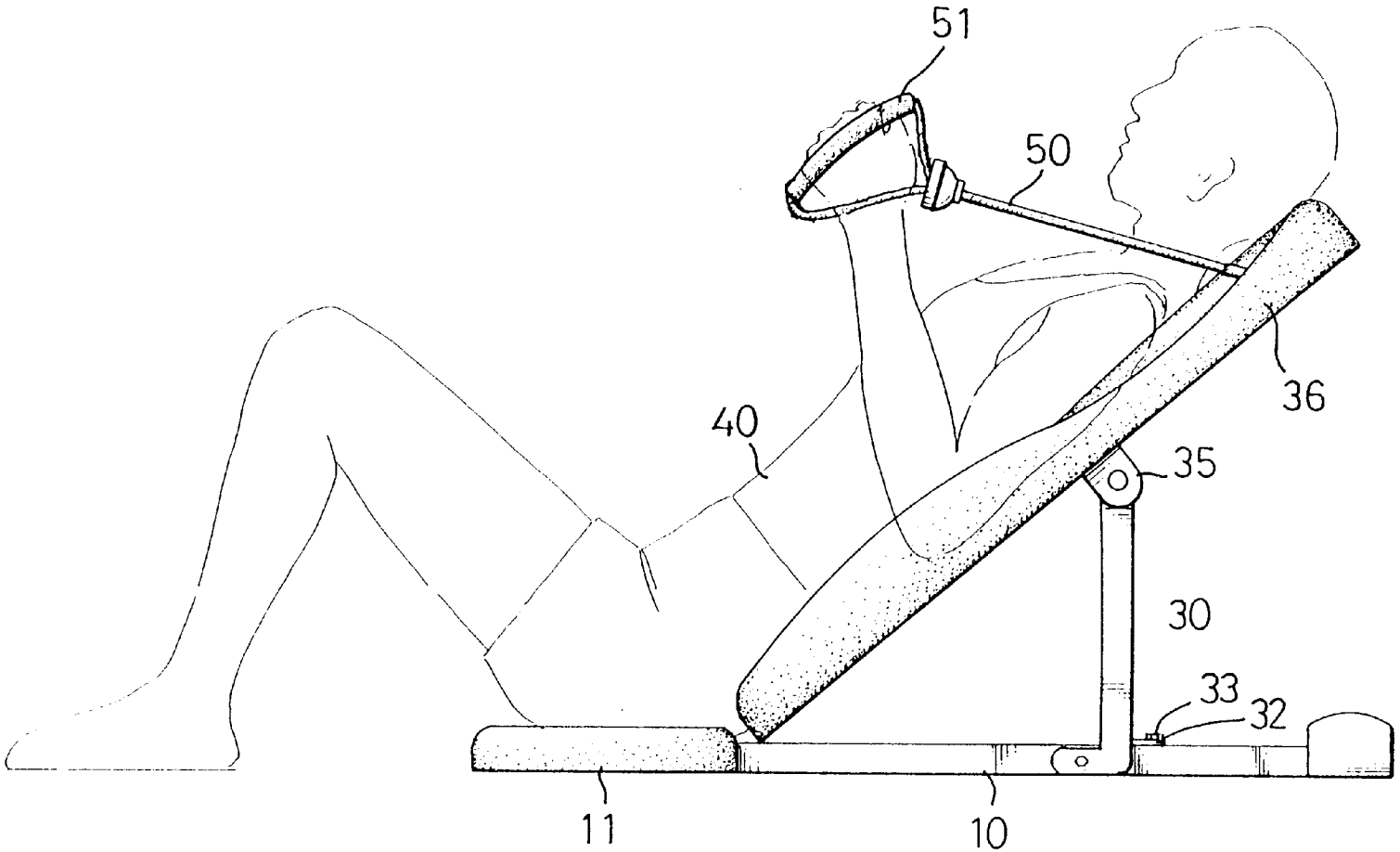
FIG. 5 is a schematic view showing a second application of the exercise device in accordance with the present invention.
Figure 6:
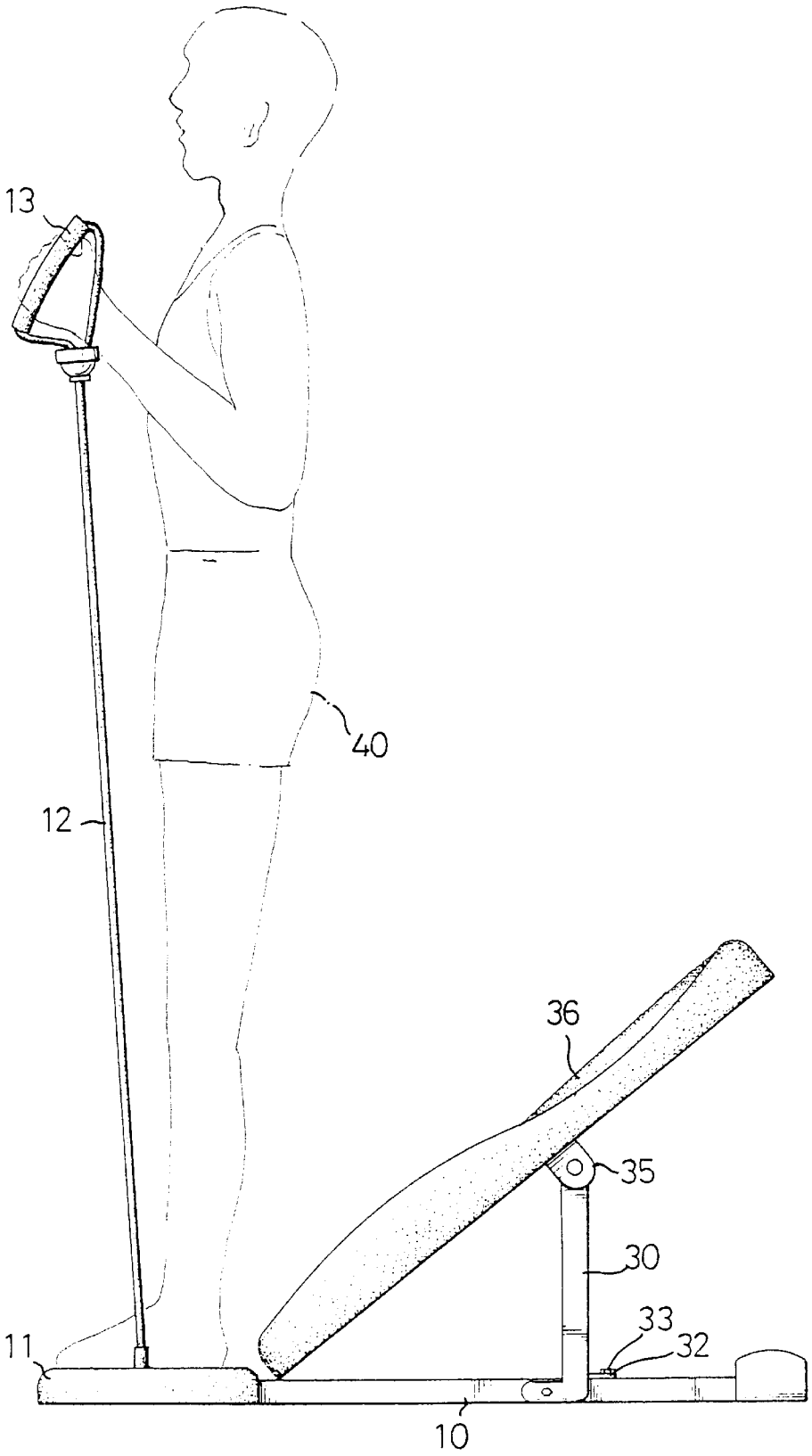
FIG. 6 is a schematic view showing a third application of the exercise device in accordance with the present invention.

FIG. 4 through FIG. 6 illustrate several different functions provided by the exercise device of the present invention. Referring initially to FIG. 4, when the third rod 30 is secured to be perpendicular to the second rod and the seatback 36 is pivoted to a horizontal position, the user 40 may lie with his back applied on the seatback 36 and have the weight element 20 applied onto his abdomen. Since the weight element 20 has a certain weight and is drawn by the pair of elastic cables 12, it will apply a force to the user abdomen when the user tries to push his/her body away from the seatback 36. By means of repeating a froggish movement, the user can build his abdominal muscles and muscles of his buttocks. It is to be appreciated that the user may adjust the weight of the weight element 20 simply by applying a desired amount of liquid into the container.

Referring to FIG. 5, when the third rod 30 is pivoted to be perpendicular to the second rod and the seatback 36 is pivoted to form an angle with respect to the seat 11, the user 40 may be seated on the seat 11 with his back leaning against the seatback 36. By repeatedly stretching the pair of resilient cables 50 the user 40 can obtain a coordinated workout of his back and arms.

Alternatively, the user 40 may stand on the seat 11 and stretch the pair of elastic cables 12 after removing the weight element 20, as shown in FIG. 6. By means of repeating the stretch movement, the user 40 may work out the muscles of his hands and arms.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exercise device comprising;

a base having a pair of parallelly spaced first rods and a second rod extending between the pair of spaced first rods;

a seat mounted on one of the pair of the spaced first rods, said seat having a pair of elastic cables respectively mounted at two sides thereof, said pair of elastic cables having two handles respectively and securely mounted to free ends thereof;

a weight element detachably mounted on the seat;

a third rod having a first end and a second end, said first end being pivotally mounted to a predetermined position of the second rod of the base; and a seatback pivotally engaging with the second end of the third rod.

2. An exercise device as claimed in claim 1, wherein said weight element has a pair of recesses defined in two sides thereof to respectively receive the pair of handles of the elastic cables.

3. An exercise device as claimed in claim 1, wherein said weight element is configured as a container in which liquid can be selectively stored to vary the weight thereof, said container having a cap mounted thereto.

4. An exercise device as claimed in claim 1, wherein said third rod has a wing perpendicularly extending therefrom and proximate the first end thereof in a manner that it can be securely attached to a surface of the second rod of the base via an insertion of a bolt through the wing and the surface of the second rod.

5. An exercise device as claimed in claim 1, wherein said seatback has a pair of resilient cables respectively mounted thereon and having a handle securely connected to free end thereof.

* * * * *